United States Patent [19]

Soloman

[11] Patent Number: 4,579,410

[45] **Date of Patent: * Apr. 1, 1986**

[54] SECURITY ATTACHMENT FOR ELECTRICAL PLUG

[76] Inventor: Leonard Soloman, P.O. Box 306, Chelsea, Mich. 48118

[ * ] Notice: The portion of the term of this patent subsequent to Jan. 22, 2002 has been disclaimed.

[21] Appl. No.: 690,232

[22] Filed: Jan. 10, 1985

Related U.S. Application Data

[63] Continuation-in-part of Ser. No. 466,406, Feb. 15, 1983, Pat. No. 4,494,809.

[51] Int. Cl.[4] ..... H01R 13/621

[52] U.S. Cl. ..... 339/75 P; 339/37; 339/82; 339/154 A

[58] Field of Search ..... 339/37, 82, 75 P, 154 R, 339/154 A, 155, 156 R, 166 R, 170, 272 R, 272 A, 75 M, 74 R

[56] References Cited

U.S. PATENT DOCUMENTS

| | | | |
|---|---|---|---|
| 2,062,125 | 11/1936 | Foster | 339/82 |
| 3,363,214 | 1/1968 | Wright | 339/12 R |
| 3,811,104 | 5/1974 | Caldwell | 339/75 P |
| 4,466,690 | 8/1984 | Osypka | 339/272 A |
| 4,494,809 | 1/1985 | Soloman | 339/75 P |

*Primary Examiner*—John McQuade

*Attorney, Agent, or Firm*—Stephenson & Boller

[57] ABSTRACT

A security attachment for an electrical plug is effective to prevent unauthorized use but to readily permit authorized use. It comprises a pair of adapter elements which are mutually plugged together between the electrical plug and a wall receptacle. One adapter is plugged together with the electrical plug and the two are connected together such that they cannot become unplugged if an attempt is made to unplug them. When unauthorized use is to be prevented, the other adapter is removed to expose prongs of the first adapter which prevent the first adapter from being plugged into the wall receptacle.

22 Claims, 8 Drawing Figures

SECURITY ATTACHMENT FOR ELECTRICAL PLUG

REFERENCE TO A RELATED APPLICATION

This is a continuation-in-part of co-pending application Ser. No. 466,406, filed Feb. 15, 1983, now U.S. Pat. No. 4,494,809 issued Jan. 22, 1985.

BACKGROUND AND SUMMARY OF THE INVENTION

This invention relates to a security attachment for an electrical plug which is effective to prevent unauthorized use but which readily permits authorized use.

In the United States and Canada, household electrical appliances are typically provided with plugs which are intended to be connected into electrical wall receptacles. The plug is usually a two prong type comprising a non-conductive body containing two electrical terminals. An insulated wire containing two separate conductors leads from the plug to the electrical appliance. One conductor of the wire connects to one prong within the plug body while the other wire connects to the other prong also within the plug body. The wall receptacle comprises two sockets containing terminals into which the prongs of the plug are plugged. The receptacle socket terminals are "live", meaning that a voltage exists across them which can be used to power the electrical appliance containing the plug. Hence, when the plug is plugged into the receptacle, circuit continuity is established such that current can flow to the appliance via one conductor and return via the other conductor. Typically the power supplied to household wall receptacles in the United States is 115 volts, 60 hertz AC, and hence the current flow is of alternating polarity at the AC frequency.

For any of a number of various reasons it may be desirable to control the usage of an electrical appliance so as to prevent unauthorized use yet permit authorized use. For example, with the advent of home video games, children can become addicted to playing them, and hence parental control of the use of such video games becomes very important. Unfortunately, it may not always be convenient for parental supervision to be exercised, such as for example when both parents are working and the children come home from school before the parents can come from work.

A novelty search conducted in connection with this invention has revealed that the prior art contains a myriad of electrical security devices for preventing unauthorized use and permitting authorize use. A vast majority of prior devices comprise lockouts in which either the plug or the receptacle is physically locked out by means of a locking device which prevents mating engagement of a plug and receptacle. U.S. Pat. No. 3,416,123 is an example of a lockout plug device applied to an electrical plug.

Many of these prior lockout devices are key operated and contain a lock mechanism. The authorized user controls the key, and hence it is possible for that person to apply the lock to the plug so that use of the appliance or device containing the plug is prevented until such time as he or she returns with the key to unlock the lock. In order to provide adequate security, such locks must often be of sufficient size and strength so that they may be relatively expensive.

The present invention is directed to a security attachment for an electrical plug which is effective to control use of a device containing the plug yet which is considerably less complicated than the locking devices of the prior art. It is deemed to be highly effective in controlling use of electrical devices such as video games by children. It does not require a locking mechanism in the sense of prior locking device utilizing padlocks, combination locks, etc. Rather, it employs two electrical adapters arranged in a new and unique manner. One adapter, in the preferred embodiment, is connected to the plug in a manner effective to prevent the two from being unplugged and to discourage children from attempting to defeat the connection. It also has prongs which are impossible to connect into the receptacle. Authorized use is permitted by plugging the second adapter into the first. When the two adapters are so plugged together, the second adapter comprises prongs which can be plugged into the wall receptacle. In this way, the two adapters, when plugged together and between the receptacle and the plug, provide electric circuit continuity from the receptacle to the plug such that electrical power from the receptacle is delivered to the electrical device or appliance containing the plug.

One advantage of the preferred embodiment of the invention as disclosed herein is that it can be sold in kit form for use with existing appliances. In other words, the owner of an electrical appliance can buy the kit, install it on the appliance plug, and control use of the appliance. First, the owner plugs the plug of the appliance into the first adapter; he or she then installs the connector which connects the first adapter to the plug to prevent the two from being unplugged. The owner then controls the use of the second adapter to thereby exercise control over use of the appliance.

The search referred to above also developed U.S. Pat. Nos. 2,761,109; 3,161,450; and 3,363,214. While between a plug and a receptacle, it is neither involved with nor suited for unauthorized use prevention. In a corresponding allowed U.S. Pat. application Ser. No. 466,406 filed Feb. 15, 1983, now U.S. Pat. No. 4,494,809, issued Jan. 22, 1985 the only references cited were U.S. Pat. Nos. 3,363,214 and 3,811,104 and the original claims were allowed over those references.

The foregoing features, advantages and benefits of the invention, along with additional ones, will be seen in the ensuing description and claims which should be considered in conjunction with the accompanying drawings. The drawings disclose a preferred embodiment of the invention according to the best mode contemplated at the present time in carrying out the invention.

DESCRIPTION OF THE PREFERRED EMBODIMENT

Figure 1:
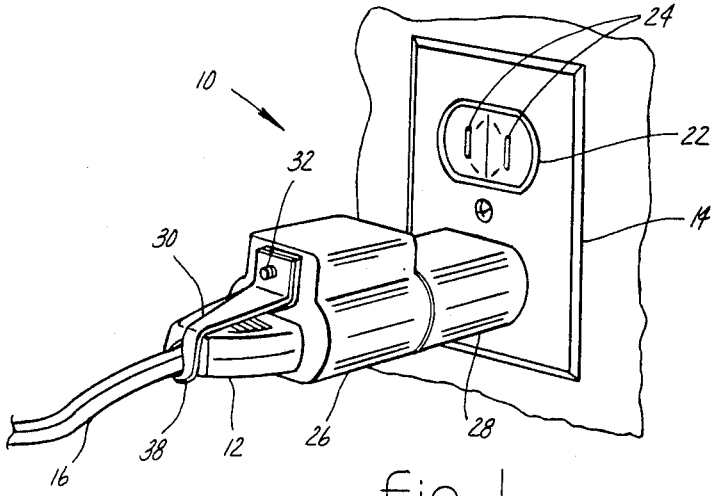
FIG. 1 is a perspective view of one embodiment of the invention in use.

The embodiment of security attachment in FIG. 1 is designated by the general reference numeral 10. It is illustrated in use between an electrical plug 12 and one receptacle of a two receptacle wall outlet 14.

Figure 2:
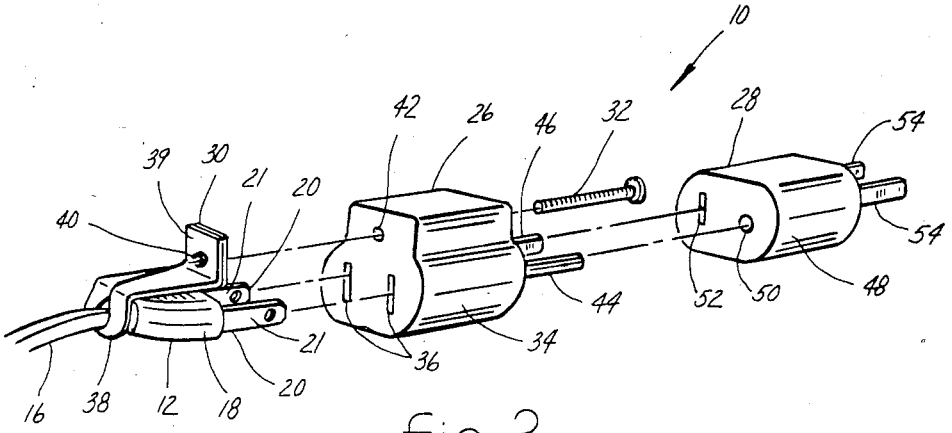
FIG. 2 is a partial exploded view of FIG. 1.

The components, with the exception of the wall outlet receptacle 14, are shown in exploded form in FIG. 2. Plug 12 is at the end of a wire 16 which leads to an electrical device or appliance (not shown) which is energized via the plug and wire. The illustrated wire 16 is an insulated, two conductor construction. Each conductor of the wire is connected within the electrically non-conducting body 18 of the plug to a corresponding one of a pair of electrical terminals 20. The terminals 20 include exterior portions, or prongs, 21 which project from the non-conducting body 18 in a parallel fashion so as to render the plug connectible with one of the wall outlet receptacles.

As can be seen in FIG. 1 the upper wall outlet receptacle, which is designated by the reference numeral 22, comprises a pair of sockets 24, each containing an electrical terminal. The prongs 21 of terminals 20 which project from body 18 may be considered as male terminals and the terminals within the sockets 24 may be considered as female terminals. The lower receptacle (unnumbered) into which the security attachment is plugged is identical to the upper receptacle. Hence, absent the security attachment of the present invention, plug 12 is readily insertable at will into the electrical outlet to provide power to the appliance containing plug 12. In the case of a video game, children can readily insert the plug 12 into the wall outlet receptacle.

The embodiment 10 of security attachment comprises a first adapter 26, a second adapter 28, a connector bracket 30, and a fastener 32. Adapter 26 and plug 12 are intended to be plugged together and connected so as to prevent them from becoming unplugged. For this purpose, adapter 26 contains a pair of electrical conductors within its non-conducting body 34. At the end of the adapter which is to be plugged into plug 12, these conductors terminate in a pair of female terminals 36 (sockets) which connect with prongs 21 of the plug. Hence, the plug can be essentially fully plugged into the first adapter to place the confronting ends of their respective bodies in substantial abutment as shown in FIG. 1.

Bracket 30 is a formed metal element having an encircling portion 38 looped around wire 16 just behind plug body 18. The bracket continues from portion 38 as a pair of overlapped sections extending lengthwise along the top side of the plug body and terminating in upstanding right angle flanges 39. Holes 40 are provided in the upstanding right angle flanges. With adapter 26 and plug 12 plugged together, a hole 42 extending axially completely through the body 34 of adapter 26 is in alignment with the holes 40 in the bracket. Fastener 32 is a screw whose shank passes through hole 42 and is threaded into the holes 40 of the bracket. The head of the fastener 32 may be of a construction which prevents convenient unfastening. For example it may be a one-way drive head which only allows the screw to be threaded into engagement with the bracket and not to be unthreaded. This would be essentially a permanent attachment which could be broken only destructively such as by cutting the bracket or by drilling out the head of the screw. Alternatively the fastener 32 need not be a one-way drive type. It could have its head countersunk into the hole 42 so that its existence is not readily apparent to one attempting to separate the adapter from its connection with the plug. This latter alternative is a suitable arrangement to discourage many children from successfully disconnecting the adapter from the plug.

The opposite ends of the two conductors extending through adapter 26 comprise terminals 44 and 46. The terminals 44 and 46 are constructed and arranged in such a manner that they cannot be plugged into the wall outlet receptacle in a manner which will be effective to establish electrical circuit continuity so that power can be supplied to the electrical device contianing plug 12. The illustrated construction for these projecting terminals comprises terminal 44 being in the form of a round pin and the terminal 46 being in the form of a flat blade. Hence, the adapter 26 installed and without the second adapter 28, it is impossible for unauthorized use of the appliance to occur.

Authorized use is permitted by the second adapter element 28. This adapter element comprises a non-conducting body 48 containing a pair of conductors. It is intended to be plugged onto the first adapter element 26. For this purpose it comprises at one end a set of terminals 50 and 52 which correspond to terminals 44 and 46 respectively such that electrical circuit continuity is established between the conductors of the two adapters when they are plugged together. Thus for the illustrated construction, the terminal 50 will be a circular receptacle within body 48 while the terminal 52 will be constructed to receive the flat blade 46 within body 48. The terminals 50 and 52 may be considered as female terminals.

The conductors of adapter 28 terminate at the far end as viewed in FIG. 2 in a pair of terminals 54 which are arranged and constructed to be plugged in to the wall outlet receptacle. Hence they are essentially identical with prongs 21 of plug 12. Therefore, when the two adapter elements 26, 28 are plugged together, and the terminals 54 are plugged into the wall outlet receptacle, electric circuit continuity is established from the wall outlet receptacle through the two adapters to plug 12 so that power can be supplied to the device or appliance containing plug 12.

It will be noted that adapter 28 is strictly of a plug-in type connection, both with the wall outlet receptacle and with adapter 26. The individual who controls possession of adapter 28 controls use of the appliance. In the case of a video game and children, a parent can keep the adapter 28 in his or her possession during times when the children are not allowed to use the game. For example, if the children come home from school and the parents are not home, the children will be unable to plug the game into a wall receptacle because the terminals 44 and 46 of the first adapter 26 do not permit connection to a receptacle. Moreover, many children will be neither perceptive nor persistent enough to defeat the system because they will be unable to separate the first adapter element from the plug. In this way unauthorized use of the video game will be prevented. When the parent returns home, he or she can connect the second adapter 28 between the first adapter 26 and the wall outlet receptacle so that authorized use is permitted. This is a convenient procedure for the parent since it involves only a plug-in connection of the adapter 28 and does not require the use of any separate tools, keys or combination locks.

By making the connection of the first adapter 26 to the plug 12 of a construction which can be disconnected only by destruction of some type, a parent will ascertain if a child has attempted to defeat, or has in fact defeated the purpose of the security attachment. Thus, the invention is particularly advantageous in that it is a relatively inexpensive device which can be easily installed in the home and which is highly effective in many situations where unauthorized use is intended to be prevented.

Figure 3:
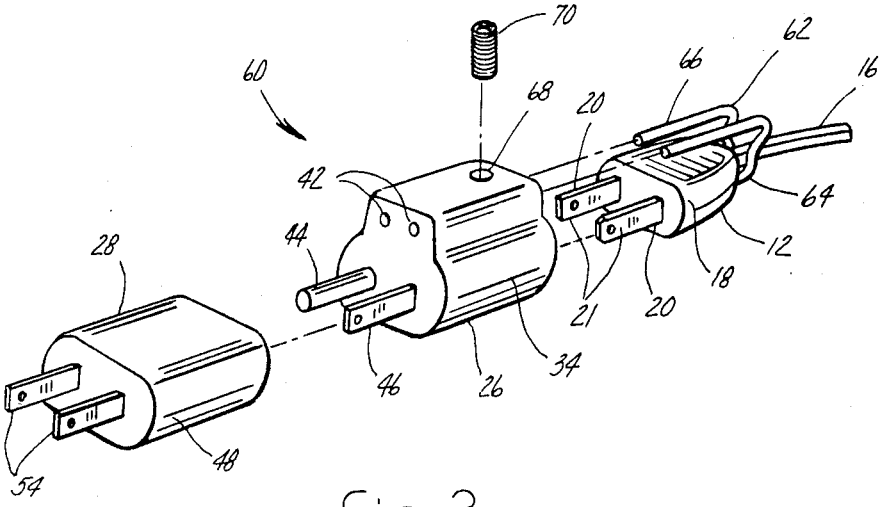
FIG. 3 is an exploded perspective view of another embodiment of the invention as viewed in the opposite direction from FIGS. 1 and 2.

FIG. 3 illustrates an alternate construction 60 for the security attachment which differs in the details of the connection between the plug and first adapter. In all other respects, the construction is the same as the first embodiment, and like reference numerals identify like parts. In the FIG. 3 embodiment, the connector element is a formed wire rod 62 one end of which (numeral 64) is looped around wire 16 just behind the plug body 18. The opposite ends 66 extend straight axially toward adapter 26, and beyond the end of the plug body so that when plug 12 is plugged into adapter 26, the straight axial sections 66 of the bracket fit into the holes 42, there being two holes 42 in the first adapter 26 of FIG. 3.

The body of adapter 26 is provided with a further hole 68 which is at a right angle to and centered between holes 42. It is open toward the top of the adapter body as viewed in FIG. 3 and it intersects both holes 42. A fastener such as a set screw 70 is threaded into hole 68 to fit between the axial ends 66 of the wire and force them apart against the walls of their respective holes 42. The set screw, when tightened, is below the level of the top of the adapter body so that it is not prominent. The use of a set screw is advantageous in that it may be provided with a socket of a non-standard configuration which requires a unique tool for its insertion and removal. This tool could be sold as a part of the security attachment. However, it is possible to use a construction containing a simple diametrical slot or a conventional hex so that conventional tools can be used.

Figure 4:
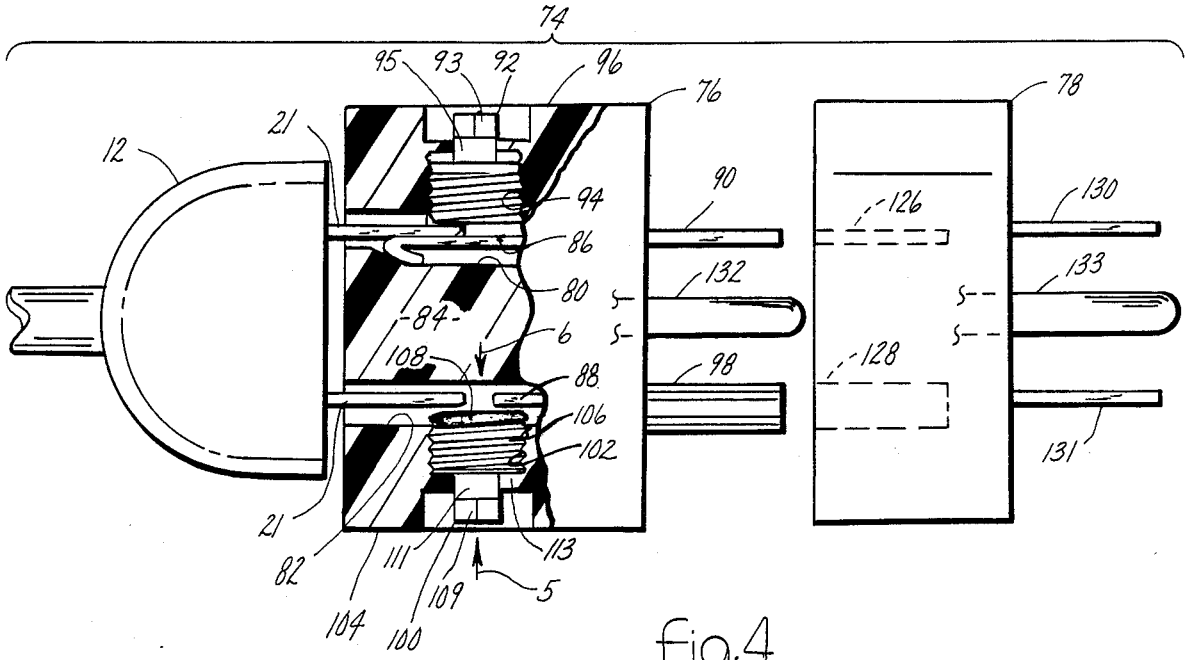
FIG. 4 is a top plan view having a portion broken away illustrating a third embodiment of the invention
Figure 5:
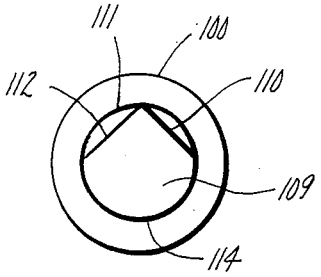
FIG. 5 is an enlarged view taken in the direction of arrow 5 in FIG. 4.
Figure 6:
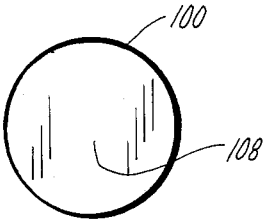
FIG. 6 is an enlarged view taken in the direction of arrow 6 in FIG. 4.

FIGS. 4, 5, and 6 illustrate a third embodiment of security attachment 74 which comprises a first adapter 76 and a second adapter 78. Adapter 76 and plug 12 are intended to be plugged together with the plug prongs 21 being inserted into sockets 80 and 82 which extend through the electrically non-conductive body 84 of adapter 76.

Adapter 76 comprises a pair of conductors 86, 88 which are respectively associated individually with the two prongs 21. Conductor 86 comprises an interior portion within socket 80 and an exterior prong portion 90 which projects from the end of non-conductive body 84 opposite where the corresponding prong 21 of plug 12 enters. Prong 90 has a rectangular tranverse shape like prong 46 in the first two embodiments.

The interior portion of conductor 86 within socket 80 is constructed and arranged such that when plug 12 is plugged into first adapter 76 the corresponding prong 21 makes electrical circuit contact with conductor 86 whereby circuit continuity is established from that prong 21 to prong 90.

Adapter 76 is locked to plug 12 by means of a non-conductive set screw 92 in a threaded hole 94 in the side wall of body 84 which intersects socket 80 at substantially a right angle. FIG. 4 shows the locked condition.

When the plug is first plugged into adapter 76, set screw 92 is disposed to allow the prong 21 to come into contact with conductor 86. Then set screw 92 is operable from the exterior side surface 96 of the adapter by means of a suitable tool (hereinafter described in connection with FIGS. 7 and 8) to be advanced into body 84 so that the interior-most end of the set screw bears forcefully against the side of prong 21 which overlaps conductor 86 within socket 80. By tightening set screw 92, a locking force is exerted on the two overlapped conductors 21, 86 which is effective to prevent the plug from being manually pulled out of the adapter. Although this manner of locking the first adapter on the plug does not comprise a mechanical interference, but rather relies upon the creation of high forces resisting separation, it is well-suited for preventing unauthorized use by children. It is possible to configure the arrangement such that the set screw when advanced would form an interference, rather than relying on the creation of a substantial pressing force, to prevent separation.

Conductor 88 has an internal portion disposed within socket 82 and an exterior portion forming a prong 98 which projects from the end of the adapter opposite plug 12. Prong 98 has a circular transverse cross section and corresponds to the prong 44 of the first two embodiments. Hence the two prongs 90 and 98 have a configuration which prevents them from being plugged into a conventional wall outlet receptacle.

It is to be observed that when adapter 76 is engaged with plug 12 as shown in FIG. 4, the distal end of the prong 21 within socket 82 is not in electrical contact with the internal portion of conductor 88. Electrical circuit continuity is established between the two by means of a set screw 100 in a threaded hole 102 intersecting socket 82 at substantially a right angle.

Set screw 100 comprises an electrically conductive body 106 (e.g. brass) having an exterior thread via which it threads on hole 102. The axial end face 108 of the set screw which is disposed within socket 82 as shown in FIG. 4 forms the electrically conductive contact between the juxtaposed ends of prong 21 and conductor 88 within socket 82 when the set screw 100 is tightened into forceful contact with them. The set screw is accessible for tightening at the exterior side surface 104 of body 84. It will be appreciated that FIG. 4 shows the set screw slightly retracted so that end face 108 is not establishing continuity between the two conductors.

FIG. 5 shows the exterior facing end of set screw 100 to have a head 109 of a non-standard shape. Head 109 comprises flat surfaces 110, 112 which are at an angle from a common vertex. A curved side surface 114 of circular contour joins the two flat side surfaces 110, 112. Head 109 is at the end of a cylindrical shoulder portion 111 which lies between the head and the body 106. The set screw is prevented from being unthreaded from hole 102 by a circular flange 113 of body 84 which overlaps the end of body 106 and which forms a circular aperture fitting closely around shoulder portion 111. Head 109 and shoulder 111 are, however, non-conductive, and hence the set screw 100 is in fact an assembly of the conductive body 106 and the non-conductive head and shoulder, the assembly being accomplished by standard fabrication procedures.

The two set screws 92, 100 are of similar construction with set screw 92 having a head 93 and shoulder 95 like head 109 and shoulder 111 of set screw 100, it being appreciated that set screw 92 is all one-piece. Set screw 92 is prevented from being unthreaded from the adapter body by means of a flange (unnumbered) corresponding to flange 113. When the adapter is being fabricated, the adapter body is molded around the set screws 92, 100 (i.e. insert molding).

Figure 7:
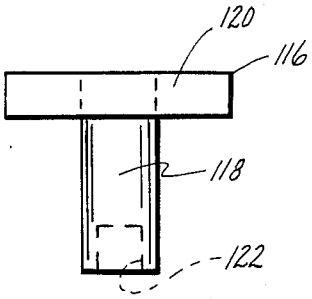
FIG. 7 is a longitudinal view of a tool which is used in connection with the embodiment of FIG. 4.
Figure 8:
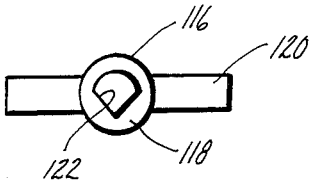
FIG. 8 is a bottom end view of the tool of FIG. 7.

FIGS. 7 and 8 illustrate a tool 116 which is adapted for operating the set screws and comprises a shank 118. A diametrically extending operator 120 is at one end while the opposite distal end contains a socket 122 having a shape complementary to the set screw heads so as to allow the distal end of shank 118 to be fitted onto each head when the proper circumferential orientation is obtained.

With the tool engaged with the head of a set screw the tool engaged can be rotated via operator 120 to advance and retract the set screw.

The preferred procedure for attaching adapter 76 to plug 12 involves the two set screws 92, 100 being sufficiently retracted to allow the prongs 21 to be inserted to the position shown in FIG. 4. Next the tool 116 is used to tighten the set screws to lock the adapter and plug together in the manner described above and with set screw 100 also serving to establish electric circuit continuity between the two conductors within socket 82. While set screw 92 is intended to provide the principal locking force in the disclosed embodiment, it will be appreciated that set screw 100 can also provide a locking force. Hence, it is possible for the set screw 100 to perform a dual function (i.e. locking plus continuity), or merely the simple function of continuity control.

The second adapter 78 is used to establish circuit continuity between the first adapter 76 and the wall outlet receptacle. For this purpose second adapter 78 is essentially the same as that shown in the first two embodiments (i.e. 28). It comprises a round receptacle terminal portion 126 for reception of prong 90 and another terminal portion 128 shaped to receive prong 98. When the two adapters 76 and 78 are connected together with prongs 90 and 98 in electrical contact with conductors 126 and 128 respectively, circuit continuity is established from the respective prongs 90 and 98 to a standard configuration of blade terminal portions 130, 131 which correspond to the terminals 54 in the preceding embodiments for insertion into a standard wall outlet receptacle.

Although the third embodiment has been shown to involve the use of a tool, that tool has been merely used for attaching of the first adapter element onto the plug. By utilizing a non-standard configuration for the tool, and by the person in authority retaining control of the tool, unauthorized tampering attempting to remove an installed first adapter from a plug will be discouraged. However, to the extent that an attempt may be partially successful, for example, by a partial unthreading of set screw 100, such unthreading will cause a loss of continuity between the one prong 21 and prong 98 so that when an authorized user attempts to use the second adapter to operate the appliance containing plug 12, it will become apparent that tampering has occurred because power will not be conducted through the security attachment to the appliance. Hence this embodiment of the invention may be deemed to have a particular advantage over the first two embodiments in that certain attempted tampering which is less than fully successful will give an indication because of the resulting inability to conduct power to the appliance when the second adapter is connected. It is to be noted that countersinks are provided in each side surface 96, 104 to provide clearance for the distal end of tool 116 to engage the set screw heads. The heads of the set screws do not project exteriorly beyond the planes of the respective side surfaces 96, 104 when in the locking position.

Although a preferred procedure has been described above for attaching the first adapter to the plug, it will be appreciated that set screw 100 could have been advanced sufficiently to establish contact with the conductor 88 before plug 12 is inserted so that when the plug is inserted, circuit continuity is immediately established.

The prongs 130 and 131 are preferably polarized. For example, prong 131 may be a standard ¼ inch blade with a "D" clip, while prong 130 may be a 5/16 inch blade. The adapters are shown to contain ground conductors 132, 133 to accommodate a three terminal (three-wire) configuration of plug 12 and the wall outlet receptacle, although it will be appreciated that the invention may be practiced in a two-wire configuration which would omit the third ground wire.

While a preferred embodiment of the invention has been disclosed, it will be appreciated that principles are applicable to other embodiments. For example, different shapes and patterns for the various components are possible.

The embodiments of the invention in which an exclusive property or privilege is claimed are defined as follows:

1. As an authorized use permitter and unauthorized use preventer for connection between an electrical receptacle having plural terminals of a given construction and pattern and an electrical plug having plural terminals of a construction and pattern which allow the plug and receptacle to be plugged together to establish electric circuit continuity between the terminals of the plug and those of the receptacle, a security attachment comprising first and second adapters, each adapter comprising its own non-conducting body and a pair of electrical conductors therein terminating at respective ends thereof in respective first and second sets of terminals, said first adapter comprising means including its first set of terminals to allow the plug and said first adapter to be plugged together and establish electric circuit continuity between the terminals of the plug and said conductors of said first adapter but to prevent the plug and said first adapter from becoming unplugged after they have been plugged together, said first set of terminals of said second adapter comprising plural terminals constructed and arranged to allow the receptacle and said second adapter to be plugged together to establish electric circuit continuity between the terminals of the receptacle and said conductors of said second adapter, said two adapters having their second sets of terminals constructed and arranged for mutual engagement to establish electric circuit continuity between their respective electrical conductors so that electric circuit continuity will thereby be established between the terminals of the plug and those of the receptacle via said two adapters when the latter are associated with their second sets of terminals in mutual engagement and with their first sets of terminals respectively plugged together with the plug and the receptacle respectively, said second set of terminals of said first adapter being constructed and arranged to preclude the possibility of establishing electric circuit continuity with the terminals of the receptacle if an attempt is made to plug together said second set of terminals of said first adapter and those of the receptacle.

2. A security attachment as set forth in claim 1 in which said first set of terminals of said first adapter are female type terminals and said first set of terminals of said second adapter are male type terminals.

3. A security attachment as set forth in claim 2 in which said second set of terminals of said first adapter are male type terminals.

4. A security attachment as set forth in claim 2 in which said second set of terminals of said first adapter comprise one flat blade type terminal and one round pin type terminal.

5. A security attachment as set forth in claim 1 in which said first adapter comprises means for providing a connection with the plug which is independent of the mutually engaged terminals of said first adapter and the plug to prevent the plug and said first adapter from becoming unplugged after they have been plugged together.

6. A security attachment as set forth in claim 5 in which the plug comprises a non-conductive body with insulated wire conductors leading away from its body and connected with the terminals of the plug and wherein said means for providing a connection of said first adapter with the plug comprises a connector element having a portion for disposition just behind the plug body to substantially encircle an insulated wire leading to the plug and another portion spaced from said first-mentioned portion and a fastener operatively engaging the body of said first adapter and connecting with said another portion of said connector element to secure said connector element and said first adapter together.

7. A security attachment as set forth in claim 6 in which said fastener is of a type which precludes non-destructive unfastening.

8. A security attachment as set forth in claim 6 in which said connector element comprises a wire element having a straight shank constituting said another portion and disposed in a hole in the body of said first adapter, and said fastener comprises a threaded fastening element disposed in another hole in the body of said first adapter intersecting said first-mentioned hole, said fastener being fastened into said another hole and against said shank of said wire element to prevent said first adapter and plug from being unplugged.

9. A security attachment as set forth in claim 8 in which said fastener, when fully tightened against said shank, is disposed fully within said another hole.

10. A security attachment as set forth in claim 6 in which said connector element comprises a formed bracket with said another portion terminating in a flange having a hole, said first adapter comprising a hole in its body which when said first adapter and the plug are plugged together aligns with the hole in said flange, and a fastener extending through the hole in the body of said first adapter and the hole in said flange to connect same together.

11. A security attachment as set forth in claim 10 in which said fastener is constructed such that once it has been operated to connect the plug and said first adapter together, the connection cannot be non-destructively broken.

12. A security attachment as set forth in claim 1 in which said first adapter comprises means for providing a connection with the plug which acts upon at least one of the plug's terminals to prevent the plug and said first adapter from becoming unplugged after they have been plugged together.

13. A security attachment as set forth in claim 12 in which said means for providing a connection with the plug which acts upon at least one of the plug's terminals comprises a member on said body of said first adapter selectively operable to a first position which permits the plug to be attached to said first adapter without interference and to a second position which causes a retention force to be exerted on said at least one of the plug's terminals to prevent the plug and said first adapter from becoming unplugged.

14. A security attachment as set forth in claim 13 in which said member comprises a threaded element disposed in a threaded hole extending from an exterior surface of said body of said first adapter and operable from the exterior of said body of said first adapter to be advanced in said threaded hole from said first position to said second position.

15. A security attachment as set forth in claim 14 in which said element comprises a head having a shape defined by flat intersecting sides which diverge from a common vertex and a curved side joining the two flat sides, said head being engageable by a tool for operating said element.

16. A security attachment as set forth in claim 13 in which said member comprises a conductive body which, when said member is operated from said first to said second position, comes into electrical contact with at least one plug terminal and the corresponding conductor of said first adapter.

17. A security attachment as set forth in claim 1 in which said first adapter comprises means for selectively controlling continuity between at least one of the terminals of the plug and the corresponding conductor of said first adapter.

18. An adapter for use in preventing unauthorized connection between an electrical receptacle and an electrical plug wherein the electrical plug has a pair of terminals projecting away from a body in substantial parallelism with each other, said adapter comprising a non-conductive body having receptacle means on a plug-receiving side into which the terminals of a plug can be inserted, said adapter comprising a pair of terminals on a side of its non-conductive body which is toward the receptacle, said pair of terminals comprising a first terminal with which a first one of the plug's terminals engages in electrical contact when the plug is plugged into said receptacle means and a second terminal which is free of electrical conductive engagement with the other of the plug's terminals when the plug is plugged into said receptacle means, a pair of bores intersecting said receptacle means from the exterior of said non-conductive adapter body, each containing a corresponding member which is operable from the exterior of the non-conductive adapter body for selective actuation along the corresponding bore, one of said bores being arranged such that the corresponding member disposed therein is selectively operable to mechanically interact with the electrically engaged terminals of the plug and of the adapter to forcefully resist separation of the plug from the adapter, and the member which is disposed in the other bore is selectively operable to control the electrical continuity between the other terminal of the plug and the second terminal of said adapter, said two members comprising non-conductive bodies but the member disposed in said other bore comprising a conductive material at the distal end thereof which selectively engages with the other plug terminal and the second adapter terminal so as to thereby control continuity between them.

19. An adapter as set forth in claim 18 in which said bores are threaded and said members comprises threaded elements disposed in said threaded bores.

20. An adapter as set forth in claim 19 in which each of said elements comprises a head having a shape defined by flat intersecting sides which diverge from a common vertex and a curved side joining the two flat sides, said head being engageable by a tool for operating said element.

21. An adapter as set forth in claim 18 in which said bores are on opposite sides of said non-conductive body and in alignment with each other.

22. An adapter as set forth in claim 21 including a counterbore at the exterior end of each bore, said members having heads disposed within said counterbores.

* * * * *